US005710543A

United States Patent [19]

Moore

[11] Patent Number: 5,710,543

[45] Date of Patent: Jan. 20, 1998

[54] EMERGENCY WARNING DEVICE AND METHOD

[76] Inventor: George David Moore, 145 E. Mountain Creek Rd., Greenville, S.C. 29609

[21] Appl. No.: 654,391

[22] Filed: May 28, 1996

[51] Int. Cl.[6] ..... G08B 3/00

[52] U.S. Cl. ..... 340/691; 340/540; 340/825.37; 116/210; 116/DIG. 8; 116/DIG. 9; 40/212

[58] Field of Search ..... 340/541, 691, 340/692, 545, 540, 825.36, 825.37; 116/210, DIG. 8, DIG. 9; 40/212, 214, 215

[56] References Cited

U.S. PATENT DOCUMENTS

| | | | |
|---|---|---|---|
| 1,057,223 | 3/1913 | Danenhower | 116/210 |
| 1,500,706 | 7/1924 | Isom | 340/691 |
| 1,924,236 | 8/1933 | Friedberg | 40/212 |
| 2,629,115 | 2/1953 | Hansen | 9/11 |
| 3,253,573 | 5/1966 | Ashline | 116/124 |
| 3,624,635 | 11/1971 | Less | 340/326 |
| 3,911,425 | 10/1975 | Muncheryan | 340/326 |
| 4,288,784 | 9/1981 | Fusco | 340/326 |
| 4,920,674 | 5/1990 | Shaeffer | 40/412 |
| 5,423,150 | 6/1995 | Hitchcock | 52/1 |

*Primary Examiner*—Jeffery Hofsass
*Assistant Examiner*—Mark S. Rushing
*Attorney, Agent, or Firm*—Robert R. Reed; Cort Flint

[57] ABSTRACT

The device of this invention has a deployable signalling or display structure for displaying messages on a display area of the structure to signal an event that exists within the building, including a distress event. The messages are provided by indicia placed on a display area of the structure. The signalling structure is large enough to be easily seen by persons who approach the entrance to the building, as well as persons at a safe distance from the building. The deployable signalling structure is stored within an enclosure adapted for installation to a portion of the building with a deployment opening directed to an exterior location away from the building. The signalling structure is deployed by forcing a fluid into the structure by way of a supply conduit from a deployment unit. A control valve is used to control the supply of fluid to the signalling structure from the deployment unit and to maintain the signalling structure deployed. The signalling structure is deployed when the deployment unit is activated by an alarm device which may be associated with the building alarm system. Dual deployment units can be used for very large signalling or display structures. A means for restoring the structure in the enclosure is also provided.

25 Claims, 5 Drawing Sheets

EMERGENCY WARNING DEVICE AND METHOD

BACKGROUND OF THE INVENTION

This invention relates to an alarm warning device or display system for a building, and more particularly to a large deployable signalling structure having a display area for displaying a readily visible message to warn the public not to enter the building. The distress sign gives an indication of a distress event within the building including a fire, a robbery in progress and the like where the entrance to the building cannot be locked.

A real and present danger exist when a person walks into a commercial building under a distress event or siege. The person is generally not aware of the dangers that exist within the building. The distress may be any type of physical problems with the building, such as exposed electrical wiring or a fire. The distress event may also be the result of a person conducting unlawful or insane acts within the building, such as a robbery or lewd acts. The entrance of the building must remain unlocked to allow those in the building to escape the dangers that the distress event causes. An employee of the building owner or others can initiate an alarm signal from inside the building. However, most building alarm systems include warning devices designed to protect persons within the building and for notifying law enforcement and fire protection authorities of the distress event. These devices generally do not provide an adequate warning for those persons who could potentially enter a commercial building under a distress event. The same warning device can be used as a retail display system when the building is locked.

An alarm warning device should also have the ability to alert law enforcement officials of the distress event. A telephone operated alarm system cannot be relied upon to get immediate help to the area of the building. In addition, the cost of having law enforcement officials within each public building is prohibitive. A more efficient alerting means is to have a device which is highly visible from a safe distance removed from the building, such as one city block. A more efficient and timely response can be made by law enforcement officials in the area when a highly visible device is deployed to announce the distress event.

Devices are know for communicating an event by deploying a balloon structure. The patent of Shaeffer (U.S. Pat. No. 4,920,674) discloses a balloon being inflated by a turbine with blades to introduce air into to a small balloon when activated by a triggering event, such as a birthday. A three dimensional message is displayed to persons in a room using a small balloon. The balloon is enlarged with respect to a container when the container is opened. No lights are disclosed to illuminate the small balloon and the device is not an emergency warning device associated with a building alarm system.

Other devices are known for signalling for emergency help. The patent of Muncheryan (U.S. Pat. No. 3,911,425) shows a small signalling unit which is activated in response to an illness or intrusion by burglars. The system is operated manually by activating an emergency switch. The alarm device includes flashing red lights inside a housing having a message cut in a front panel. The device does not have an inflatable structure and the small signaling unit is designed for portability.

The patent of Less (U.S. Pat. No. 3,624,635) shows a distress signal system disposed on a roof or other prominent portion of a dwelling which is activated in response to an emergency condition within the dwelling. The system is operated in an emergency by an occupant-manipulated switch. The system does not have a highly visible display for persons approaching the dwelling, as there is only one standard light bulb inside a protective cover located on a roof.

A similar device is disclosed for mounting on a wall or post in the patent of Fusco (U.S. Pat. No. 4,228,784). This device has a remote controlled relay that energizes a small standard security light and rotating emergency alarm lamps. There is no highly visible structure and a controlled relay operates only the emergency alarm lamps.

Signalling balloons are well known in the art for remote search and rescue applications. The patents by Hansen (U.S. Pat. No. 2,629,115) and Ashline (U.S. Pat. No. 3,253,573) disclose balloons associated with land and sea survival situations. Balloons are automatically inflated to deploy at a high elevation during emergency situations. These systems do not relate to commercial building security and safety systems as they are used in very remote locations to signal aircraft conducting a search. The patent of Danenhower (U.S. Pat. No. 1,057,223) shows a signal balloon inflated by compressed air. The usage is for submarines at sea.

These references do not disclose a device large enough to effectively signal people or keep them from entering a commercial building under siege. The signalling devices of the art do not have highly visible deployable signalling structures for the exterior of the building with a stay-away message. The prior art does not provide the combination of suitable lighting to illuminate a message on such signalling structure. The art does not provide an emergency message that can be readily observed at a safe distance, as well as from the entrance to a building. The need remains to have a device and system highly visible on commercial buildings to give proper warning in the case of a distress event.

Accordingly, an object of the present invention is to provide a highly visible emergency warning device to be seen by persons outside a commercial building under a distress event. The device should include a large readily visible structure to be stored until the distress event exists and for deploying the structure when activated by the alarm device.

Another object of the present invention is to keep persons away from a building under siege. A highly visible emergency warning device should be used to include components for storing a collapsed signalling structure and deploying the structure on demand as needed. Indicia properly placed on the deployed structure may be provided to give a clear message to stay away from the building. Visibility of the indicia may be enhanced by lighting the structure.

Yet another object of the present invention is to define a method for providing an emergency warning signal to persons approaching an entrance to a commercial building under siege. The method should include the steps of installing devices and activating the system for deploying a highly visible signalling structure.

A further object of the present invention is to use the same emergency warning device when a distress event is no longer a problem or the building is locked and not in service. This invention can be used to provide a large display system for any message to be highly visible to the public from an exterior to a public, commercial or retail sales building.

SUMMARY OF THE INVENTION

The above objectives are accomplished according to the present invention by a warning device and method or a display system that provides a deployable signalling structure which is highly visible to persons disposed to an exterior of a commercial building.

The present invention includes a highly visible emergency warning device for being seen by persons approaching an entrance to a commercial building under a distress event. The warning device comprises a deployable signalling structure having a storage position in which the structure is stored and a deployed position in which the structure is extended for providing a highly visible display to the persons. An enclosure is adapted for installation to an exterior portion of the building having an internal compartment with a deployment opening through which access may be had for storing and deploying the deployable signalling structure. A deployment unit is for discharging a fluid into the signalling structure for deploying the signalling structure by way of the deployment opening of the enclosure when the deployment unit is activated. The warning device further comprises an alarm device connected to the deployment unit for activating the deployment unit from the building in response to the distress event. The signalling structure is extended from the stored position to a fully deployed position by discharging the fluid to the inside of the signalling structure for providing a highly visible display area on the signalling structure. Indicia inscribed on the highly visible display area of the signalling structure is for announcing the distress event when said signalling structure is in the deployed position and viewed by the persons. The indicia is for warning the persons against entrance to the public building.

Another embodiment of the present invention comprises a method for providing an emergency warning signal highly visible to persons approaching an entrance to a commercial building under siege. The method is described by the following steps. A first step includes installing an enclosure to a portion of the building. The enclosure has and internal storage compartment with a deployment opening disposed to an exterior of the building. A second step includes storing a deployable signalling structure within the compartment of the enclosure by way of the deployment opening. The signalling structure has warning indicia inscribed thereupon. In a third step the method includes providing a deployment unit connected to the signalling structure for deploying the signalling structure from the compartment when the deployment unit is activated. The deployable signalling structure presents a highly visible display area with the indices located on the display area. A fourth step includes deploying the stored signalling structure from within the internal storage compartment through the deployment opening of the enclosure by activating the deployment unit to deploy the signalling structure to the exterior of the building. The indicia on the highly visible display area gives the emergency warning signal to persons outside the building.

An alternate embodiment of the present invention includes using the warning device and method for a highly visible display system for persons outside a commercial or retail sales building. The comprising system comprises a deployable display structure which may be compressed for storage and deployed on demand to provide a highly visible display area for readily viewing by the persons. The highly visible display area of the display structure has indicia inscribed thereupon for displaying a message to the persons. An enclosure adapted for installation to a portion of the building has an internal storage compartment for providing storage for the display structure and a deployment opening through which the display structure is deployed external to the building. A deployment unit is associated with the enclosure and connected to the display structure for deploying the structure from a stored position within the storage compartment to a deployed position by way of the deployment opening. The system also comprises an activation unit for activating the deployment unit when a first electrical signal is received from the activation unit.

A further embodiment of the present invention includes a lighting unit for illuminating the indicia on the display area of the signalling or display structure for enhancing the visibility of the indicia to persons. The lighting unit includes colored flood lamps and strobe lights for illuminating the indicia.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail. The highly visible emergency warning device or display system of this invention can be seen by persons approaching a commercial building having an event to announce, including a distress event. The device has a deployable signalling structure for displaying messages on a display area of the structure to signal the danger, for example, that exists within the building by warning statements or other indicia placed on a display area of the structure to be easily seen by persons from an exterior to the building. The deployable signalling structure is stored within an enclosure adapted for installation to the building with a deployment opening directed to the exterior of the building. The signalling structure is deployed by forcing a fluid into the structure by way of a supply conduit from a deployment unit. A control or actuation valve is used to control the supply of fluid to the signalling structure from the deployment unit.

Figure 1:
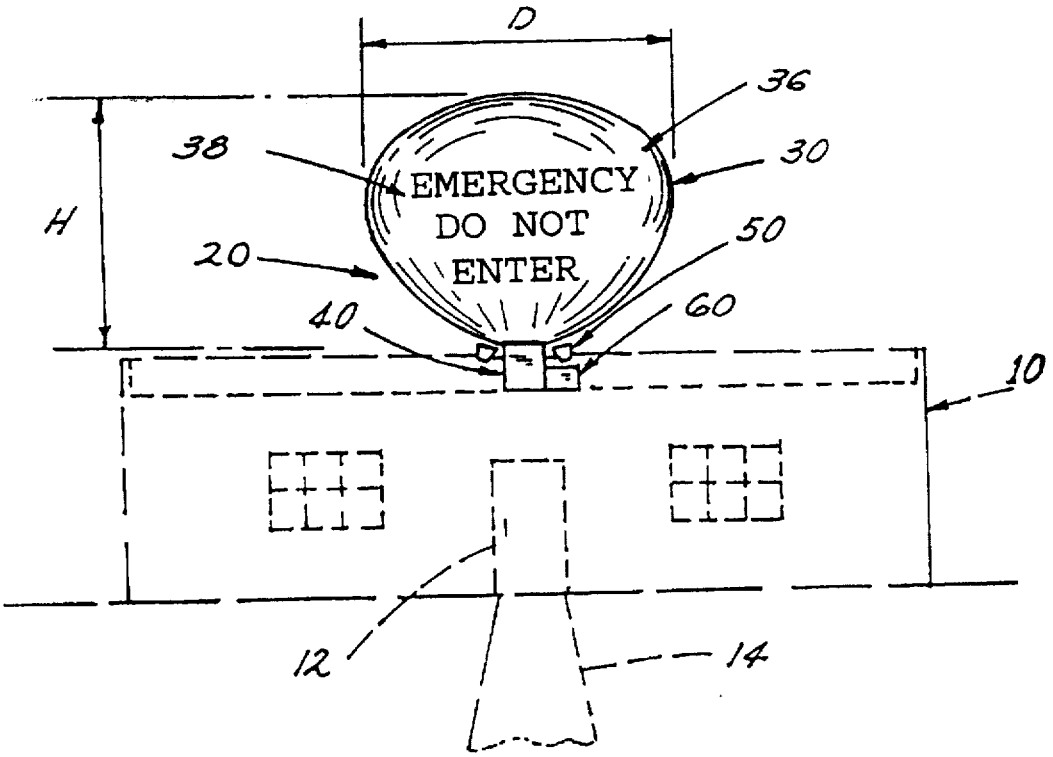
FIG. 1 is a front elevation view of a commercial building having a highly visible warning device of this invention installed on the roof of a commercial building.

The invention is best described by referring to the emergency warning device 20 associated with a commercial building 10 as illustrated in FIG. 1. The commercial building 10 having an entrance 12 is under distress. Therefore, any person that may enter the building can be subjected to physical or emotional harm. A person aware of the distress has initiated an alarm signal which activates the emergency warning device located to an exterior portion of the building. A signalling structure 30 has been deployed to be highly visible from a walkway 14 to the exterior of the building 10. The signalling structure has been compressed for storage within an enclosure 40 and is now fully deployed. An air deployment unit 60 is for providing air to fully inflate or deploy the signalling structure. A display area 36 on the deployed signalling structure 30 is easily viewed by a person approaching the entrance 12 of the building 10. The size of the signalling structure is such that the display area 36 is readily seen and obvious to anyone in the area of the building in time to avoid entry into, or further association with, the building. For example, a suitable size of the display area is that which gives a display dimension D of at least 10 feet and preferably 15 feet and a height H of the signalling structure should be at least 10 feet and preferably approximately 30 feet in height. However, larger sizes may be used depending on the application and cost effectiveness of a larger size. A display area in the range of about 100 square feet to about 600 square feet is anticipated. A preferred display area is approximately 450 square feet for general applications of the signalling structure. Other sizes and various shapes can also be used, provided the signalling structure is effectively visible at a safe distance from the building and prior to entry.

A plurality of indices 38 on the display area 36 conveys a proper highly visual message to anyone approaching the building, and noticeable for persons at a safe distance from the building. For example, the message may be "EMERGENCY ALARM DO NOT ENTER", as illustrated in FIG. 1. The indicia can be further enhanced by a lighting unit 50 to illuminate the display area 36 to make the warning message more obvious. The lighting unit can be especially useful at night. The size of the signalling structure can be made sufficient to alert law enforcement officials who may be approaching the general location of the building. The signalling structure is to be made large enough to be highly visible from a safe unobstructed distance of one city block or more from the building. The warning device of this invention can be designed for each application depending on the size of the building and its location with respect to other buildings in the general area. More than one warning device may be necessary in a city location where other buildings do not provide viewing of the signalling structure from all approaching locations.

Figure 2:
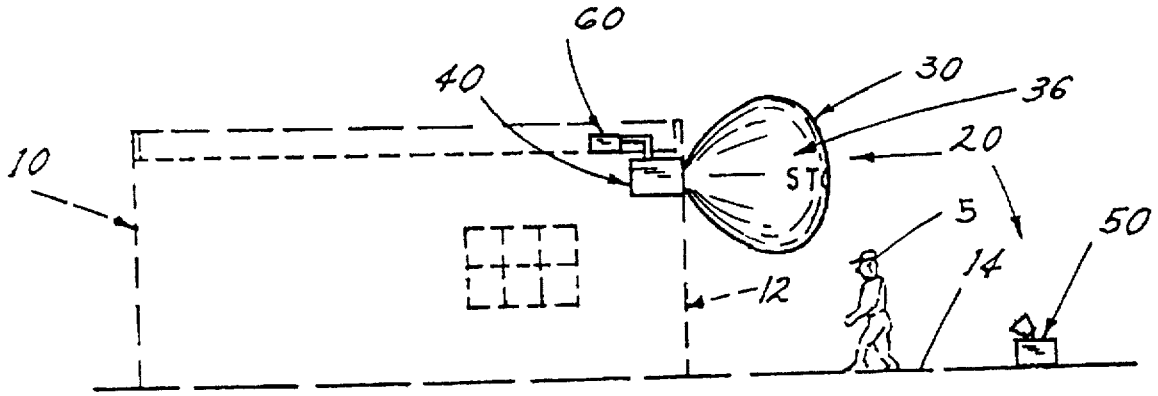
FIG. 2 is a side elevation view of a commercial building having a highly visible warning device of this invention deployed to the front of the building.

An alternate location of the emergency warning device of this invention is shown by the embodiment illustrated in FIG. 2. Surface mounted devices may be more desirable in cold or wet weather regions of the world and may include means for keeping ice from forming on the device or means for removing ice from the device. In this embodiment a person 5 is stopped by the deployable signalling structure 30 being deployed from a vertical front face above the entrance 12 of the building 10. For this embodiment, the message is the indicia "STOP" displayed directly above the entrance 14. The enclosure 30 is mounted to have a deployment opening to the front of the building. The air deployment unit 60 is located on a roof and the lighting unit 50 is located adjacent the walkway 14 to illuminate the display area 36. Other locations and arrangements of the components of the emergency warning device or display system are also within the scope of this invention. The enclosure 40 must be positioned for proper deployment of the signalling structure 30 and for easy access for servicing. The air deployment unit 60 is preferably located near the enclosure 40 and the lighting unit 50 must be placed such that the display area 36 can be illuminated.

Figure 3:
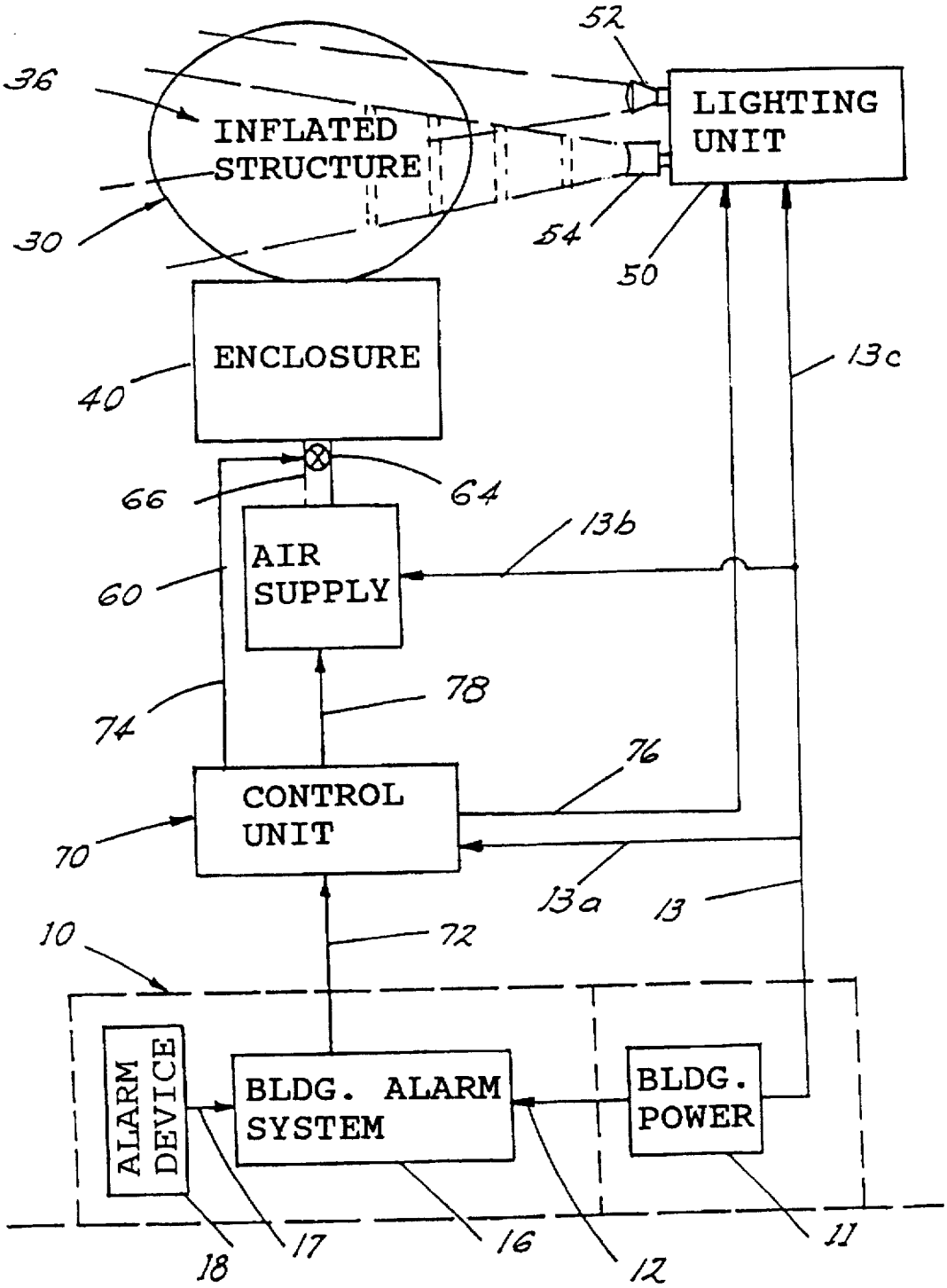
FIG. 3 is a block diagram showing the interconnecting relationships between components of the emergency warning system of this invention.

A highly visible emergency warning system for persons approaching an entrance to a commercial building under siege is illustrated by the flow diagram of FIG. 3. The structure 30 has been deployed from an enclosure 40. The deployment may be by inflation with a fluid or any mechanical means to reach the deployed position illustrated. The preferred method is to use a fluid to deploy or inflate the structure. The structure is compressed for storage in the enclosure and deployed to become a signalling structure 30 on demand which is highly visible. The enclosure is adapted for installation to the exterior of the building 10. The structure preferably deployed by a deployment unit 60 associated with the enclosure and connected to the structure through a supply conduit 66 for deployment. The deployment unit deploys the signalling structure when activated by a control or activation unit 70. The activation unit can be any electrical switching device that provides electrical energy to the deployment unit on demand. Preferably, electrical energy comes from the building power 11 by way of a main power cable 13 and control power cable 13*a*.

When a distress event exists within a commercial building, an alarm device 18 can be physically activated. The block diagram of FIG. 3 illustrates the preferred system to include an alarm device which transmits an electrical signal over a distress signal cable 17 to the building alarm system 16. The building alarm system may also be energized by electrical energy through an alarm power cable 12. A separate electrical control circuit is provided to transmit a first electrical signal over a first electrical signal cable 72. The first electrical signal makes a demand to the activation unit 70 to send a second electrical signal to the deployment unit 60 for activation of the deployment unit 60. A deployment unit power cable 13*b* may also be used to supply electrical energy directly to a deployment unit which requires such power, such as a fan. Once again, the deployment unit is activated to provide the signalling structure in a deployed condition for viewing to the exterior of the building.

In a further embodiment of the invention, a lighting unit 50 is provided for illumination of the signalling structure. In particular, the lights 52 and 54 are directed to the display area 36 on the signalling structure 30 (FIG. 3). The activation unit provides an electrical lighting signal transmitted over a lighting cable 76, and electrical power for the lighting unit is provided by the lighting power cable 13*c*.

Figure 4:
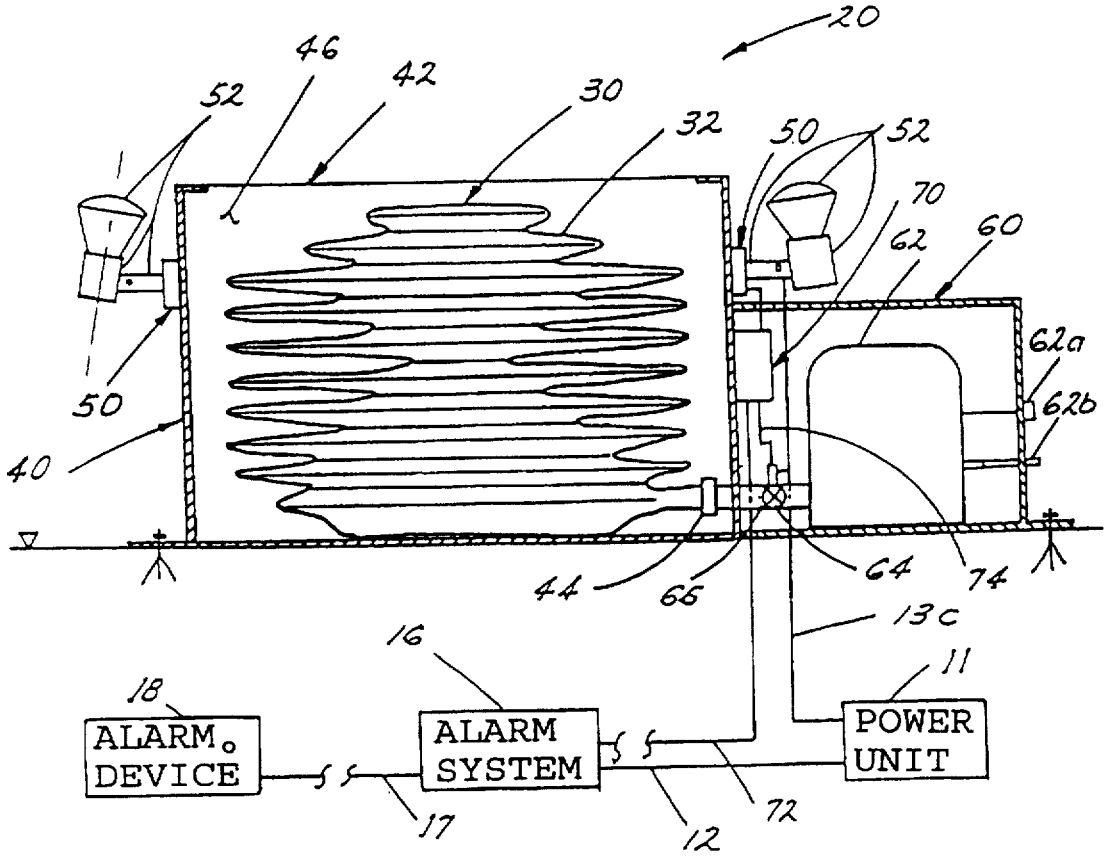
FIG. 4 is a cross-sectional view of the preferred embodiment of the warning device of this invention showing an inflatable air bag structure in a collapsed position prior to deployment.

Further details of one embodiment of a highly visible emergency warning device of this invention are illustrated in FIG. 4. The signalling structure 30 is stored within an enclosure 40 to be deployed on demand from the deployment opening 42. The signalling structure comprises a plurality of resilient compressible panels to form an inflatable air bag 32. The air bag as referred to in this invention is made of a material to retain air as much as possible. Panels may be made from any one of a group of materials including but not limited to mylar, fiberglass, rubber and nylon fabric. A deployment unit 60 inflates the signalling structure by forcing a fluid to the inside of the structure. The fluid passes through a supply conduit 66 from the deployment unit to the collapsed structure. A control valve 64 is placed in the supply conduit to control the fluid flow into the structure. The deployment unit for this embodiment includes a container 62 having an inert gas under pressure. When the control valve 64 is open the inert gas flows into the deployable signalling structure 30 to deploy the structure. The control valve is closed or modulated to maintain the signalling structure deployed.

Activation of the warning device is provided by a control or activation unit 70, as illustrated in FIG. 4. The activation unit receives a first electrical signal by way of a first electrical cable 72 from a building alarm system 16. The building alarm system is energized by a building power cable 12 from the building power unit 11. The building alarm system is activated by an alarm device 18 in response to a distress event. The alarm device is connected to the alarm system by an alarm signal cable 17. The activation unit transmits a second or control valve electrical signal by way of a control valve cable 74 to the control valve 64. The control valve can be a typical solenoid activated valve well known in the art.

The warning device of this invention may be operated by electrical signals transmitted by wireless transmitter and receiver devices being remote from one another. A transmitter device associated with an alarm device within the building can transmit signals to a receiver device associated with the activation unit at the enclosure. Transmissions may be at any functional wave length including radio frequency (RF) or sound waves. Transmitter and receiver devices are well known in the industry for remote transmission of electrical control signals.

A lighting unit 50 is used to illuminate the signalling structure after it has been deployed. Flood lamps 52 of the lighting unit can be attached to the enclosure 40, as illustrated in FIG. 4. The lighting unit is activated by a second electrical signal by way of a second electrical cable 74. Electrical power for the lighting unit is provided from the building power unit 11 over a lighting power cable 13*c*. The placement of the flood lamps is not critical provided the deployed signalling structure can be illuminated. Other type lamps and lights can also be included with the lighting unit.

Other embodiments of the invention include a self contained system that includes a deployment unit, an enclosure, a lighting unit and a signalling structure. This self contained system may be battery powered and activated by separate switch or button in association with a distress event within the building. The self contained system and others variations of a highly visible deployable signalling structure are within the scope of this invention. Self contained systems may be made to be independent of the building alarm system. For example, manufacturers of bank alarm devices and alarm systems may prohibit any device being attached to a bank security system. In a simplified variation of the embodiment illustrated in FIG. 4, a separate alarm device 18 can be connected directly to a control valve 64 to activate the deployment unit 60 and deploy the signalling structure to provide a simplified warning device 20. Electrical power for the deployment unit can also be provided by standard battery units in the simplified embodiment of the warning device of this invention.

Figure 5:
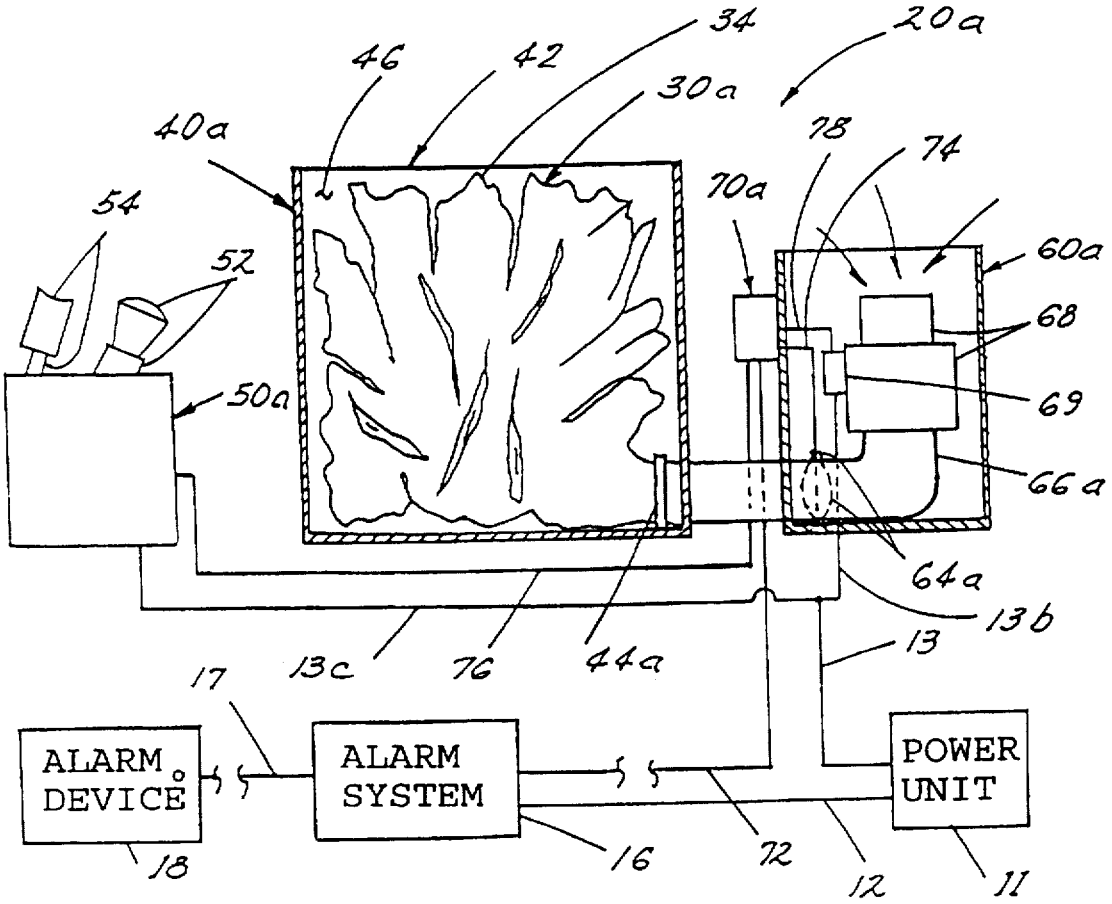
FIG. 5 is a cross-sectional view of another embodiment of the warning device of this invention showing an inflatable membrane structure in a collapsed position prior to deployment.

Another embodiment of the warning device 20 of the present invention is illustrated in FIG. 5. The signalling structure 30*a* is stored within an enclosure 40*a* to be deployed on demand from the deployment opening 42. The enclosure is adapted for installation to an exterior portion of the building so that the deployment opening is accessible and not obstructed. The signalling structure comprises an elastic membrane 34 affixed to the enclosure and compressed for storage and deployment from an internal compartment 46 of the enclosure. The signalling structure is attached to a deployment unit 60*a* for discharging a fluid into the structure. The deployment unit includes a fan 68 that forces ambient air coming into the fan to be discharged through a supply conduit 66*a* into the signalling structure for deploying the structure. A control valve 64*a* has an open position to allow ambient air to flow into the signalling structure and a closed or modulated position to maintain ambient air within the structure. The control valve is activated by a second electrical signal from an activation unit 70*a* through a second electrical cable 74. The fan 68 has a fan switch 69 controlled by an electrical fan signal by way of a fan control cable 78. Power to the fan is provided from the building power unit 11 through a fan power cables 13 and 13*c*.

The warning device 20*a* of the embodiment illustrated in FIG. 5 is also activated by the alarm device 18 of the building alarm system 16. Once again, an alarm signal is transmitted over the alarm cable 17 to the building alarm system that generates a first alarm signal to be transmitted over the first electrical cable 72 to the activation unit 70*a*. The activation unit activates the fan 68, the control valve 64*a* and the lighting unit 50*a* to make the warning device 20*a* operational.

A remote lighting unit 50*a* is deployed exterior to the building for illuminating indicia on a display area of the elastic membrane 34 when fully deployed, as previously disclosed. The lighting unit is powered by a lighting power cable 13*c* from the building power unit 11 and the power cable 13. Control of the lighting unit is provided by a lighting electrical signal through the lighting control cable 76 from the activation unit 70*a*. The lighting unit includes flood lamps 52 and strobe lights 54 for illuminating the deployed signalling structure.

A simplified embodiment of the warning device 20*a* illustrated in FIG. 5 is also within the scope of this invention. As previously disclosed, in a simplified variation of the present embodiment the alarm device 18 can be connected directly to a control valve 64 to activate the deployment unit 60*a* and deploy the elastic membrane 34 to provide a simplified warning device. Electrical power for the deployment unit 60*a* can also be provided by standard battery units in this simplified embodiment of the warning device 20*a*.

Figure 6A:
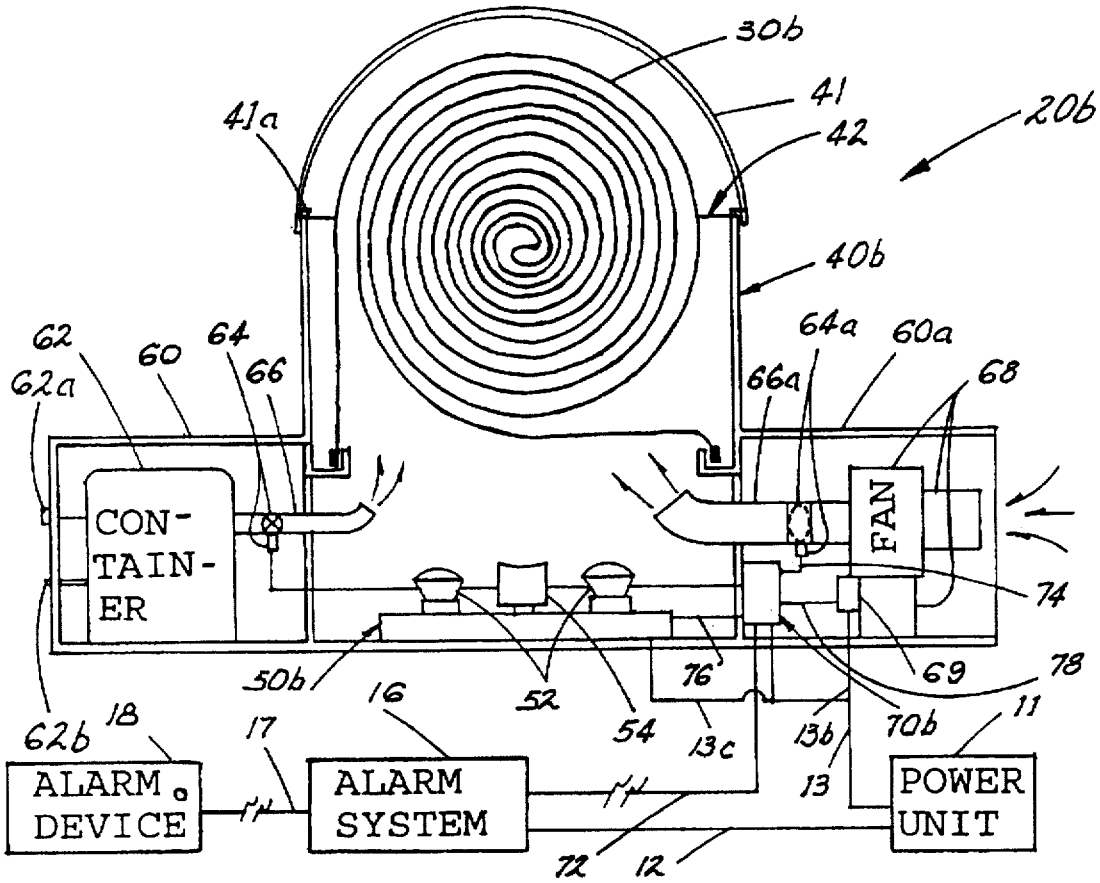
FIG. 6A is a cross-sectional view of a third embodiment of the warning device of this invention showing dual deployment units and an internal lighting unit.
Figure 6B:
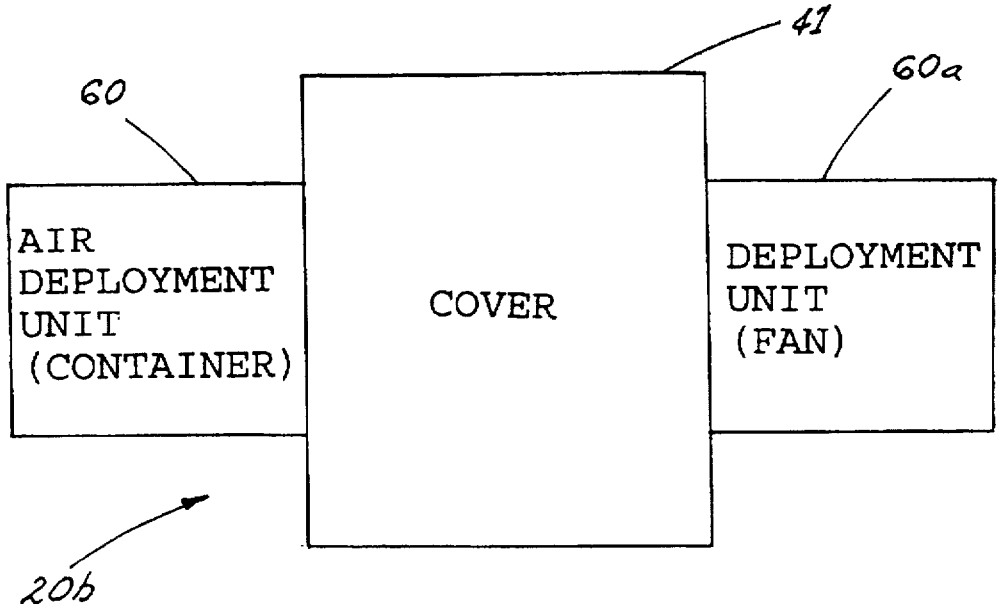
FIG. 6B is a plan view of the warning device of the third embodiment of this invention.

A combination of warning device components may be used for a further embodiment of a warning device or display system 20*b* of this invention, as illustrated in FIGS. 6A and 6B. The deployable signalling or display structure 30*b* has a stored position for deployment from a coiled configuration. A cover 41 is provided on the top of the enclosure 40*b* for protecting the display structure from cold and wet weather conditions and to close the deployment opening 42. The cover may have a hinge 41*a* which allows the cover to rotate to the side when the display structure is deployed. Two deployment units are used in this embodiment. A first deployment unit includes a container 62 containing an inert gas under pressure. The inert gas is discharged into the display structure for initially deploying the display structure in a relatively short period of time. A second deployment unit includes a fan 68 for discharging ambient air to help deploy the display structure and for helping to maintain the display structure in a deployed position. A combination of both deployment units is useful for many applications, including a relatively large signalling or display structure having a relatively large display area; say about 450 square feet.

A first control valve 64 activated by a second electrical signal from an activation unit 70*b* controls the flow of inert gas from the container 62. A second control valve 64a activated by a third electrical signal from the activation unit 70b controls the flow of ambient air from the fan 68. A lighting unit 50b may be disposed inside the enclosure 40b including colored flood lights 52 and strobe lights 54. The display structure is made to be translucent so that indicia on its display area when deployed can be internally illuminated. The activation unit 70b gives control signals that operate the first and second deployment units as required. Other components of this embodiment are as defined and discussed in the previous sections. The various components of this display system or warning device are well protected against adverse climatic conditions as apparent by a top view, as illustrated in FIG. 6B.

The signalling or display structure of this invention can be restored in the enclosure after a warning device or display system message is no longer needed. The deployment unit is deactivated by the actuation unit giving a stop signal to discontinue deployment of the structure. The structure collapses and a restorage means is provided to allow a signalling structure 32 to be returned to the interior compartment 46 of the enclosure 40 (FIG. 4). A connector 44 is provided to allow the signalling structure to be removed for replacement or restructuring. A restorage means includes providing a new signalling structure as well as using the same signalling structure which is placed in a condition for being stored again in the enclosure. Restorage means for the same signalling structure can be folding the deflated structure by hand or automatically restructuring the structure by using a machine.

While a preferred embodiment of the invention has been described using specific terms, such description is for illustrative purposes only, and it is to be understood that changes and variations may be made without departing from the spirit or scope of the following claims.

What is claimed is:

1. A highly visible emergency warning device for being readily seen by persons approaching an entrance to a commercial building under a distress event, said warning device comprising:

a deployable signalling structure having a storage position in which said structure is stored and a deployed position in which said structure is extended for providing a highly visible display to said persons;

an enclosure adapted for installation to an exterior portion of said building having an internal compartment with a deployment opening through which access is made for storing and deploying said deployable signalling structure;

a deployment unit for discharging a fluid into said signalling structure to deploy said signalling structure by way of said deployment opening of said enclosure when said deployment unit is activated;

an alarm device connected to said deployment unit for activating said deployment unit from said building in response to said distress event;

said signalling structure being extended from said stored position to said deployed position by discharging said fluid to the inside of said signalling structure for providing a highly visible display area of said signalling structure; and indicia inscribed on a highly visible display area of said signalling structure for announcing said distress event when said signalling structure is in said deployed position when viewed by said persons, said indicia for warning said person against entrance to said public building.

2. The warning device set forth in claim 1 wherein said display area of said inflatable structure has an area in a range of about 100 square feet to about 600 square feet when said signalling structured has been deployed.

3. The warning device set forth in claim 2 wherein said display area of said inflatable structure has an area of approximately 450 square feet.

4. The warning device set forth in claim 1 including a lighting unit for illuminating said indicia on said display area of said inflatable structure when deployed, and said lighting unit also being activated by said alarm device.

5. The warning device set forth in claim 4 wherein said lighting unit includes flood lamps and strobe lights for lighting and attracting said persons attention to said indicia, said lamps and lights are positioned to an exterior of said building for directing said lamps and lights to illuminate said indicia.

6. The warning device set forth in claim 1 wherein said deployable signalling structure includes a plurality of folding resilient panels connected together to form an inflatable air bag affixed to said enclosure and connected to said deployment unit, said inflatable air bag being inflated and deployed from said deployment opening of said enclosure so that said highly visible display area of said air bag is in a position for said highly visible display.

7. The warning device set forth in claim 1 wherein said deployable signalling structure includes an inflatable elastic membrane affixed to said enclosure and connected to said deployment unit, said elastic membrane being inflated and deployed from said deployment opening of said enclosure so that said highly visible display area of said elastic membrane is in a position for said highly visible display.

8. The warning device set forth in claim 1 wherein said alarm device is connected to a building alarm system that transmits a first electrical signal to an activation unit which in turn transmits a second electrical signal for activating said deployment unit.

9. The warning device set forth in claim 1 wherein said deployment unit includes a container having said fluid under pressure, said fluid being an inert gas which is released from said container into said deployable signalling structure for deploying said signalling structure when said deployment unit is activated by said alarm device.

10. The warning device set forth in claim 9 including a supply conduit between said deployment unit and said enclosure for transferring said inert gas from said container into said signalling structure for deploying said signalling structure.

11. The warning device set forth in claim 10 wherein said supply conduit includes an air control valve operated by an activation unit for releasing said inert gas into said signalling structure for deploying said signalling structure and for maintaining said signalling structure in a deployed configuration.

12. The warning device set forth in claim 1 wherein said deployment unit includes a fan which blows ambient air into said deployable signalling structure for deploying said signalling structure when said deployment unit is activated by said alarm device.

13. The warning device set forth in claim 12 including a supply conduit between said deployment unit and said enclosure for connecting said fan to said signalling structure for transferring said ambient air from said fan to said signalling structure, said supply conduit including an air control valve for allowing said ambient air to be transferred when said valve is open and for maintaining said signalling structure in a deployed configuration when said valve is closed.

14. A highly visible display system for persons outside a commercial building comprising:

a deployable display structure which is compressed for storage and deployed on demand to provide a highly visible display area for readily being viewed by said persons;

said highly visible display area of said display structure having indicia inscribed thereupon for displaying a message to said persons;

an enclosure adapted for installation to a portion of said building having an internal storage compartment for providing said storage of said display structure and having a deployment opening through which said display structure is deployed external to said building;

a first deployment unit associated with said enclosure and connected to said display structure for deploying said structure from a stored position within said storage compartment to a fully deployed position by way of said deployment opening;

activation unit for activating said first deployment unit when a first electrical signal is received from said building by said activation unit; and said first deployment unit including a container having a fluid under pressure which is released through a supply conduit into said display structure for deploying said display structure when said first deployment unit is activated by said actuation unit.

15. The display system set forth in claim 14 including a lighting unit for illuminating said indicia on said display area of said display structure from the interior to said display structure for enhancing the visibility of said indicia by said persons, wherein said lighting unit includes colored flood lamps and strobe lights for illuminating said indicia.

16. The display system set forth in claim 14 including a first control valve located in said supply conduit and activated by a second electrical signal from said actuation unit so that said inert gas can be released into said display structure for deploying said display structure when said valve is open and for maintaining said display structure fully deployed when said valve is closed.

17. The display system set forth in claim 16 including:

a second deployment unit also associated with said enclosure and connected to said display structure for helping to deploy said structure from a stored position within said storage compartment to a fully deployed position by way of said deployment opening;

said activation unit also activating said second deployment unit when a first electrical signal is received from said building by said activation unit; and said second deployment unit includes a fan which blows ambient air into said display structure through a supply conduit for helping to deploy said structure when said second deployment unit is activated by said actuation unit.

18. The display system set forth in claim 17 including a second control valve located in said supply conduit to be activated by a third electrical signal from said actuation unit so that said ambient air is released into said display structure for helping to deploy said display structure when said valve is open and for helping to maintain said display structure fully deployed.

19. A method for providing an emergency warning signal highly visible to persons approaching an entrance to a commercial building under siege, said method including the steps of;

a) installing an enclosure to a portion of said building, said enclosure having and internal storage compartment with a deployment opening disposed to an exterior of said building;

b) storing an inflatable signalling structure within said compartment of said enclosure by way of said deployment opening, said signalling structure having a warning indicia inscribed thereupon;

c) providing a deployment unit connected to said signalling structure for deploying said signalling structure from said compartment when said deployment unit is activated so that said deployable signalling structure can present a highly visible display area with said indices located on said display area; and d) deploying said stored signalling structure from within said internal storage compartment through said deployment opening of said enclosure by activating said deployment unit to deploy said signalling structure to the exterior of the building, wherein said indicia on said highly visible display area gives said emergency warning signal; and e) providing a display area on said inflatable structure of up to about 450 square feet when said structure fully deployed.

20. The method set forth in claim 19 including the step of providing an actuation unit for activating said deployment unit, said actuation electrically connecting an alarm device associated with a building alarm system of said building to said deployment unit for activating said deployment unit in response to a distress event within said building.

21. The method set forth in claim 19 including the step of illuminating said indicia on said highly visible display area of said signalling structure when deployed using a lighting unit also activated by said actuation unit.

22. The method set forth in claim 19 wherein the step of deploying said signalling structure using said deployment unit includes the step of storing an inert gas under pressure within a container and activating a control valve from an actuation unit for releasing said inert gas from said container through a supply conduit into said inflatable structure for deploying said signalling structure when said valve is open and for maintaining said signalling structure fully deployed when said valve is modulated.

23. The method set forth in claim 19 wherein the step of deploying said signalling structure using said deployment unit includes the steps of providing a fan for blowing ambient air into said inflatable structure through a deployment conduit and activating a control valve in said supply conduit for releasing said ambient air into said structure for deploying said signalling structure when said valve is open and for maintaining said signalling structure fully deployed when said valve is modulated.

24. A method for providing an emergency warning signal highly visible to persons approaching an entrance to a commercial building under siege, said method including the steps of;

a) installing an enclosure to a portion of said building, said enclosure having and internal storage compartment with a deployment opening disposed to an exterior of said building;

b) storing a deployable signalling structure within said compartment said enclosure by way of said deployment opening, said signalling structure having a warning indicia inscribed thereupon;

c) providing a deployment unit connected to said signalling structure for deploying said signalling structure from said compartment when said deployment unit is activated so that said deployable signalling structure can present a highly visible display area with said indices located on said display area; and d) deploying said stored signalling structure from within said internal storage compartment through said deployment opening of said enclosure by activating said deployment unit to deploy said signalling structure to the exterior of the building, wherein said indicia on said highly visible display area gives said emergency warning signal;

e) deactivating the deployment unit to allow the signalling structure to be deflated; and f) reinstalling a signalling structure within said internal storage compartment of said enclosure, said reinstalling step including providing one of either another or the same deployable signalling structure having a storable configuration for repeating said steps of storing and deploying said deployable signalling structure.

25. The method set forth in claim 19 including the step of providing an actuation unit for activating said deployment unit, said actuation unit electrically connecting a switching means associated with said building for activating said deployment unit in response to a distress event within said building.

* * * * *